US007838846B2

(12) United States Patent
Pinsky

(10) Patent No.: US 7,838,846 B2
(45) Date of Patent: Nov. 23, 2010

(54) ROCKING TOOTHBRUSH SANITIZER

(76) Inventor: Joel Pinsky, 200 E. End Ave. 12-0, New York, NY (US) 10128

( * ) Notice: Subject to any disclaimer, the term of this patent is extended or adjusted under 35 U.S.C. 154(b) by 442 days.

(21) Appl. No.: 12/044,006

(22) Filed: Mar. 7, 2008

(65) Prior Publication Data

US 2009/0189084 A1 Jul. 30, 2009

Related U.S. Application Data

(63) Continuation-in-part of application No. 29/302,794, filed on Jan. 24, 2008, now Pat. No. Des. 573,263.

(51) Int. Cl.
*G01N 23/00* (2006.01)

(52) U.S. Cl. ..... 250/455.11; 250/454.11; 206/206.1

(58) Field of Classification Search ..... 250/455.11
See application file for complete search history.

(56) References Cited

U.S. PATENT DOCUMENTS

| | | | | |
|---|---|---|---|---|
| 4,816,648 | A | 3/1989 | Dusbabek | 219/521 |
| 4,906,851 | A * | 3/1990 | Beasley et al. | 250/455.11 |
| 4,950,902 | A | 8/1990 | Ritter | 250/455.11 |
| 4,973,847 | A | 11/1990 | Lackey et al. | 250/455.1 |
| 5,023,460 | A * | 6/1991 | Foster et al. | 250/455.11 |
| 6,135,279 | A | 10/2000 | Dryer | 206/362.1 |
| 6,253,773 | B1 | 7/2001 | Ingemann | 132/310 |
| 6,565,819 | B1 | 5/2003 | Herrera | 422/298 |
| 6,702,113 | B2 | 3/2004 | Marino | 206/362.2 |
| 6,753,537 | B2 * | 6/2004 | Woo | 250/455.11 |
| 6,967,337 | B1 | 11/2005 | Fonowich | 250/455.1 |
| D523,674 | S | 6/2006 | Starck | D06/534 |
| D528,334 | S | 9/2006 | Starck | D06/534 |
| D539,582 | S | 4/2007 | Starck | D06/534 |
| 7,213,603 | B2 | 5/2007 | Pinsky | 132/310 |
| 7,547,893 | B1 * | 6/2009 | Tantillo | 250/455.11 |
| 2004/0089815 | A1 | 5/2004 | Woo | 250/455.11 |
| 2004/0155201 | A1 | 8/2004 | Russell et al. | 250/455.11 |
| 2006/0204416 | A1 | 9/2006 | Hayes et al. | 422/28 |
| 2007/0056864 | A1 | 3/2007 | Cottrell | 206/209 |
| 2007/0109797 | A1 * | 5/2007 | Reda | 362/418 |
| 2007/0295916 | A1 | 12/2007 | Reuben | 250/455.1 |

* cited by examiner

*Primary Examiner*—David A. Vanore
*Assistant Examiner*—Phillip A. Johnston
(74) *Attorney, Agent, or Firm*—Robert Platt Bell

(57) ABSTRACT

A toothbrush or the like may be inserted, bristles downward, into an aperture in a cap removably attached to a body of the apparatus. A peg may be inserted into any one of the apertures in order to allow an electric toothbrush head or other non-standard type of toothbrush to be used. An internal ultraviolet (UV) bulb is located in the apparatus to sanitize the toothbrushes. A timer/control circuit may activate the UV bulb for three minutes and then shut off. To prevent the recurrence of bacterial growth over time, the UV bulb may be automatically reactivated by the timer/control circuit after six hours and activated for another 3 minutes or another amount of time, as programmed. A safety mechanism may interact with a spring-loaded microswitch coupled to the timer/control circuit to disable the unit if the cap is removed. The body has a rounded bottom and is weighted such that the sanitizing apparatus sits upright on a flat surface and returns to an upright position if tipped.

20 Claims, 4 Drawing Sheets

ROCKING TOOTHBRUSH SANITIZER

CROSS-REFERENCE TO RELATED APPLICATIONS

The present application is a Continuation-In-Part of U.S. Design patent application Ser. No. 29/302,794 filed Jan. 24, 2008, and incorporated herein by reference.

The subject matter of the present application is related to that in U.S. Pat. No. 7,213,603, issued May 8, 2007 and incorporated herein by reference; the subject matter of the present application is also related to that in U.S. Design Pat. No. D539,582, issued Jan. 18, 2006, and incorporated herein by reference; the subject matter of the present application is also related to that in U.S. Design Pat. No. D528,334, issued Sep. 19, 2006, and incorporated herein by reference; the subject matter of the present application is also related to that in U.S. Design Pat. No. D523,674, issued Jun. 27, 2006 and incorporated herein by reference; the subject matter of the present application is also related to that in Co-Pending U.S. Design patent application Ser. No. 29/267,527, filed on Oct. 16, 2006, and incorporated herein by reference.

FIELD OF THE INVENTION

The present invention relates to an apparatus for sanitizing and storing toothbrushes. In particular, the present invention is directed toward an apparatus, which uses a germicidal ultraviolet light to sanitize toothbrushes when the toothbrushes are stored therein, having a counterweighted base allowing the device to rock without tipping over.

BACKGROUND OF THE INVENTION

The use of ultraviolet light to sanitize toothbrushes is known in the art. Hylton et al., U.S. Pat. No. 4,806,770, issued Feb. 21, 1989 and incorporated herein by reference, discloses a germicidal toothbrush holder. The apparatus of Hylton includes a substantially closed, upright cylindrical housing having a detachable top lid. The lid has an annular array of openings through which the bristled ends of toothbrushes may be inserted and removed. A UV lamp of low intensity is operably mounted within the housing for emitting ultraviolet radiation in the 200 to 300 nanometer wavelength range, as well as some radiation in the visible range above 300 nanometers and in the ozone producing range below 200 nanometers. A removable cup structure supports the bristled ends of the toothbrushes in an annular array immediately surrounding the lamp, and has an annular interior surface coated with aluminum for high reflectance of UV radiation.

Hylton discloses that his UV lamp is on continuously to expose the toothbrushes to germicidal radiation and to generate small quantities of ozone which accumulate to have some sterilizing effect. However, it is not clear whether the bulb he uses is optimized for best germicidal radiation (253.7 nm) or whether such a battery operated low intensity bulb can provide any appreciable germicidal effect.

The lower portion of the housing is translucent to visible light, so that the holder operates as well as a nightlight for the bathroom. Hylton does disclose a switch for turning off the apparatus, but describes the apparatus operating "continuously". Hylton discloses using a "low intensity" bulb as a safety feature such that if a child removes the cover and peers inside, presumably no eye damage will occur.

However, such a "safety" feature compromises the effectiveness of the apparatus. Moreover, it is not clear than even a "low intensity" bulb would be safe. As the apparatus of Hylton is designed to remain on all night (e.g. as a night light) it consumes energy at all times. Moreover, the user is never apprised as to whether the toothbrushes inserted therein are indeed sanitized. Thus, a requirement remains in the art for better safety features, which allow for higher intensity UV bulb usage. In addition, a requirement remains in the art for a sanitizer which is not on all of the time.

Ellis, U.S. Pat. No. 4,088,445, issued May 9, 1978, and incorporated herein by reference, discloses a combination night-light and sterilizing holder for toilet articles. A hollow body member has a plurality of side opening pockets at the upper portion thereof to receive toilet articles such as toothbrushes. The inner ends of the pockets have openings into the interior of the body member providing exposure to sterilizing radiation from an uncoated portion of a light bulb supported within the housing. The light emitted from the coated portion serves as a night light. At the top of the holder is a shelf for supporting containers thereon in inverted relation whereby the containers are also sterilized by the bulb.

As with Hylton, Ellis envisions an apparatus which appears to be on all the time, wasting energy when not in use. Moreover, there do not appear to be any safety features to prevent eye exposure to the uncoated mercury vapor bulb of Ellis. Thus, Ellis does not address the deficiencies of Hylton.

Chu, U.S. Pat. No. 5,126,572, issued Jun. 30, 1992, and incorporated herein by reference, discloses a toothbrush holder. A personal health care item in the form of a toothbrush holder is provided comprising means to support one or more toothbrushes, and an ultraviolet irradiating light device to treat the brush of any toothbrush mounted within the toothbrush support means and thus kill any germs present within the brush. This novelty toothbrush holder is provided with a switch for activating the apparatus when a toothbrush is inserted. A timer activates the apparatus for 1 to 10 minutes. A battery-operated bulb is used.

While the apparatus is provided with a timer and switch, the switch contacts the bristles of the apparatus, possibly spreading contamination between brushes. In addition, no safety features are provided. The novelty aspect of the invention (cartoon heads) invites children to play with the device. Such a device, designed for children should be provided with a "fail-safe" security system.

Abernathy, U.S. Pat. No. 3,820,251, issued Jun. 28, 1974 and incorporated herein by reference, discloses a toothbrush-drying device. Toothbrushes are inserted into a housing having a heating device and a source of ultraviolet light. A timer is used to activate the device. Like the other devices cited above using timers, it appears that in Abernathy, once the timer goes off, the light is extinguished until reset. Thus, if a toothbrush is left in the device for an extended period of time, bacteria could grow unchecked.

In addition, there do not appear to be any safety features to this device—it appears it may be opened while in use. In addition, the toothbrushes must be inserted into a rack within a recessed cylinder, with the heads up. It would appear that this would cause unnecessary handling of the toothbrush head, and would also be awkward to use.

Andary et al., U.S. Pat. No. 3,954,407, issued May 4, 1976 and incorporated herein by reference, discloses an automatic toothbrush sterilizer. Andary provides a safety mechanism in that the toothbrushes are inserted into the device and then rotated into place before a sanitizing lamp.

It appears that Andary leaves the UV light on all the time, except when a toothbrush is inserted or removed from the apparatus. Moreover, the rotary chamber design is not user friendly, as the user must rotate the apparatus chamber to insert and release toothbrushes—possibly why Andary envisions a wall-mounted device. The apparatus is also fairly complex, and thus expensive to produce.

Moreover, all of the aforementioned apparatus doe not provide any means for sanitizing anything other than a traditional toothbrush. Modern electric toothbrushes may be provided with removable heads and the like. Such removable heads are not readily adaptable to the toothbrush sanitizers of the Prior Art.

In addition, the various apparatus discussed above do not appear to be easy to clean. As toothbrushes tend to drip water, unused toothpaste, and the like, toothbrush holders tend to accumulate unsavory gunk over time and need to be periodically rinsed. The devices discussed above do not appear to be readily cleaned.

The Andary device, for example, provides an elaborate safety mechanism to prevent UV light from reaching the user. However, this apparatus does not appear to be easily disassembled or cleaned. A device which can be readily taken apart presents obvious UV safety hazards to the user. Thus, the two conflicting requirements—safety and ease of cleaning—have yet to be addressed in the Prior Art by one apparatus.

Thus, it remains a requirement in the art to provide an apparatus which is relatively simple in design and is easy to use. It remains a further requirement in the art to provide an apparatus which may control the amount of time a UV light is applied to the toothbrushes, without being on all the time or going off after only a few minutes. It further remains a requirement in the art to provide an apparatus with a safety feature to shut the apparatus off if an attempt is made to open the device while in use.

It further remains a requirement in the art to provide a toothbrush sanitizer, which may be used with non-traditional toothbrushes and other items such as electronic toothbrush heads and the like. It further remains a requirement in the art to provide a toothbrush sanitizer which may be readily disassembled and cleaned to remove accumulate toothpaste and the like.

U.S. Pat. No. 7,213,603, issued May 8, 2007 discloses an ultra-violet toothbrush sanitizer, whose design features are also described in U.S. Design Pat. No. D539,582, U.S. Design Pat. No. D528,334, U.S. Design Pat. No. D523,674, and Co-Pending U.S. Design patent application Ser. No. 29/267,527. This design is presently marketed by VioLight® Incorporated, assignee of the present application. VioLight® Incorporated also markets a travel model VioLight® toothbrush sanitizer. Examples of these products can be viewed at the violight.com website, incorporated herein by reference.

Appliances for use in the bathroom are multiplying quickly. In addition to electric toothbrushes, water jets, electric razors, radios, and other devices, ultraviolet light toothbrush sanitizers made by the Violight Corporation are also popular with users. As a result, the home bathroom vanity can become crowded with electrical appliances, which in the presence of water, can be a dangerous combination. If a device tips over, it may be damaged or fall into a sink full of water, causing an electrical shock or resulting in a blown circuit breaker or tripped ground-fault interrupter.

One Prior Art solution was to make the base of such appliances large, so as to prevent them from tipping over. But with limited vanity space, a large base appliance may not be practical. Electric toothbrush charging stands and the like may be provided with wall mounting tabs so that they may be mounted on the wall, freeing up space on the vanity. However, such an approach requires the homeowner to drill holes in the wall and mount screws for the appliance. Many homeowners may not have the inclination or skill to drill such mounting holes Renters may not be inclined to damage the wall surface. In an all-tile bath, such drilling may damage tiles or be difficult to do.

Thus, it remains another requirement in the art to provide an electric toothbrush sanitizer that does not require a large base or wall mounting in order to be stable and to minimize counter space usage.

SUMMARY OF THE INVENTION

The apparatus of the present invention is provided with one or more apertures in a cap removably attached to a body of the apparatus. In the preferred embodiment one aperture are used, although other numbers of the apertures may be used within the spirit or scope of the present invention.

A toothbrush or the like may be inserted, bristles downward, into the aperture. In addition to toothbrushes, the apparatus of the present invention may also receive one or more electric toothbrush head(s) or other apparatus to be sanitized. As will be discussed in more detail below, a removable peg may be inserted into any one of the apertures in order to convert that the aperture for use with an electric toothbrush head or other non-standard type of toothbrush or other apparatus (e.g., child's toothbrush).

Once a toothbrush or toothbrushes are inserted into an aperture a membrane button may be pressed to activate an internal ultraviolet (UV) bulb placed in proximity to the toothbrushes as will be discussed below. The membrane button may comprise a membrane covering a microswitch or other type of switch.

When the membrane button is pressed, a timer/control circuit may be activated. This timer/control circuit may be implemented on an integrated circuit or with discrete components as is known in the art. The timer/control circuit may activate the UV bulb for a first predetermined amount of time (e.g., 3 minutes) and then shut off.

To prevent the recurrence of bacterial growth over time, the UV bulb may be automatically reactivated by the timer/control circuit after a second predetermined amount of time (e.g., 6 hours) and activated for the first predetermined amount of time (e.g., 3 minutes) or another amount of time, as programmed. Thus, for example, every few hours, the UV bulb may be activated to restrain the growth of bacteria on the toothbrushes inserted in the apparatus.

Thus, a user may have confidence that the toothbrushes are at a constant state of cleanliness, no matter how long they have been left in the apparatus. Moreover, no intervention is required by the user to automatically reactivate the apparatus over time.

A safety mechanism may interact with a spring-loaded microswitch coupled to the timer/control circuit to disable the unit if the cap is removed. When the cap is removed, pressure on a safety mechanism is released, and a spring-loaded switch on the circuit board is tripped, deactivating the UV bulb. Thus, unlike some of the prior art devices discussed above, the present invention will automatically shut off if an attempt is made to open the device while in use.

The cap may be provided with one or more extended portions, one of which may interact with the safety mechanism such that when the cap is removed, a user cannot merely press the safety mechanism to activate the device, as the safety mechanism is recessed into the body of the apparatus. Thus a child cannot remove the cap and press on the safety mechanism and activate the UV/germicidal bulb, as the safety mechanism is recessed in the body of the drip cup and the cap must be in place for the safety mechanism to be depressed.

The apparatus of the present invention is shaped, in the preferred embodiment in an egg shape. The apparatus is weighted at the bottom, either through inserted weights (e.g., lead ballast) or by batteries, such that the device will wobble when placed on a flat surface, but will always return to an upright position when tipped. This wobble base technique insures that the device will not tip over easily, and if tipped, that it returns to an upright position. The wobbling technique also provides an amusement feature to the user, in that it may oscillate back and forth when a toothbrush is inserted. Alternately, a movable weight maybe inserted into the device, motor-driven to make the device wobble like a metronome, while the sanitizing process is going on. The use of the rounded egg shape along with the weighted base allow the device to take up a minimal amount of space on a countertop or vanity. The self-balancing feature means that rather than trying to prevent tipping, the device allows for some tipping, but providing a self-righting feature to prevent the device from tipping over completely. The egg shape also provides an attractive appearance to the user and works well with the bathroom décor.

DETAILED DESCRIPTION OF THE INVENTION

Figure 1:
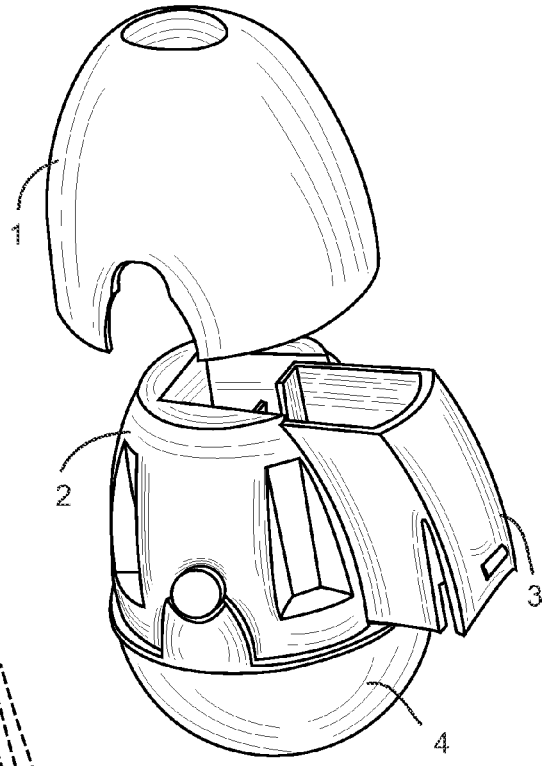
FIG. 1 is a partially exploded perspective view of the ROCKING TOOTHBRUSH SANITIZER of the present invention.
Figure 3:
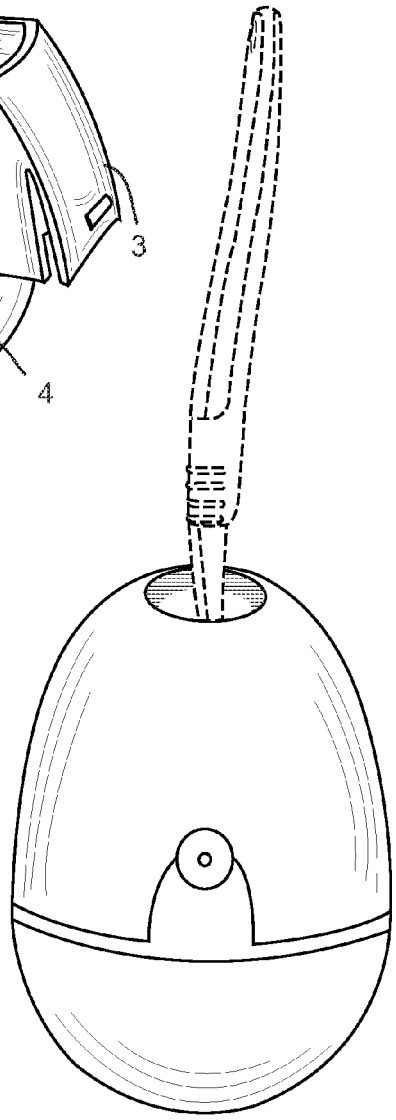
FIG. 3 is another front perspective view of the ROCKING TOOTHBRUSH SANITIZER of the present invention.
Figure 10:
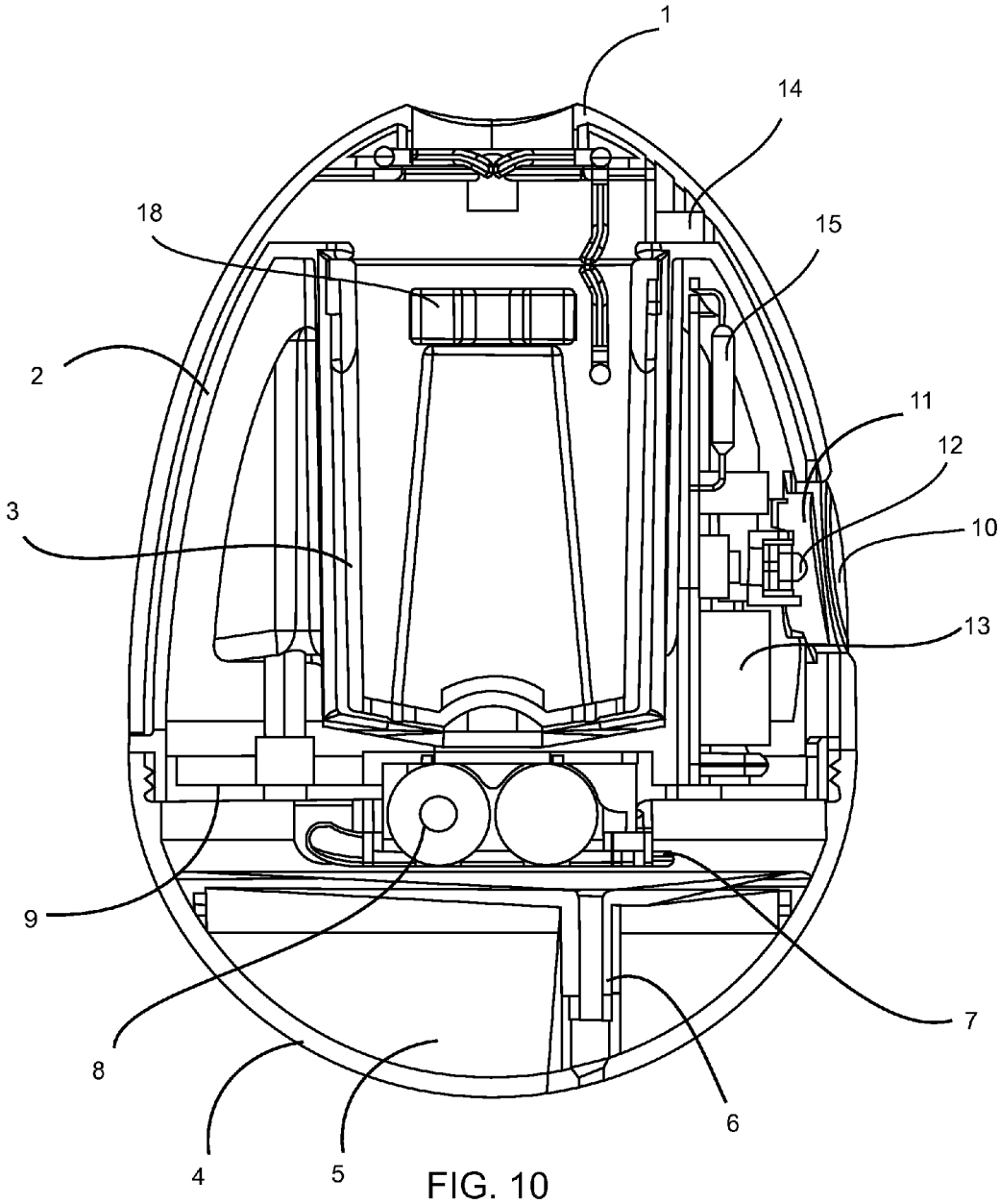
FIG. 10 is a cross-sectional view of the ROCKING TOOTHBRUSH SANITIZER of the present invention.
Figure 11:
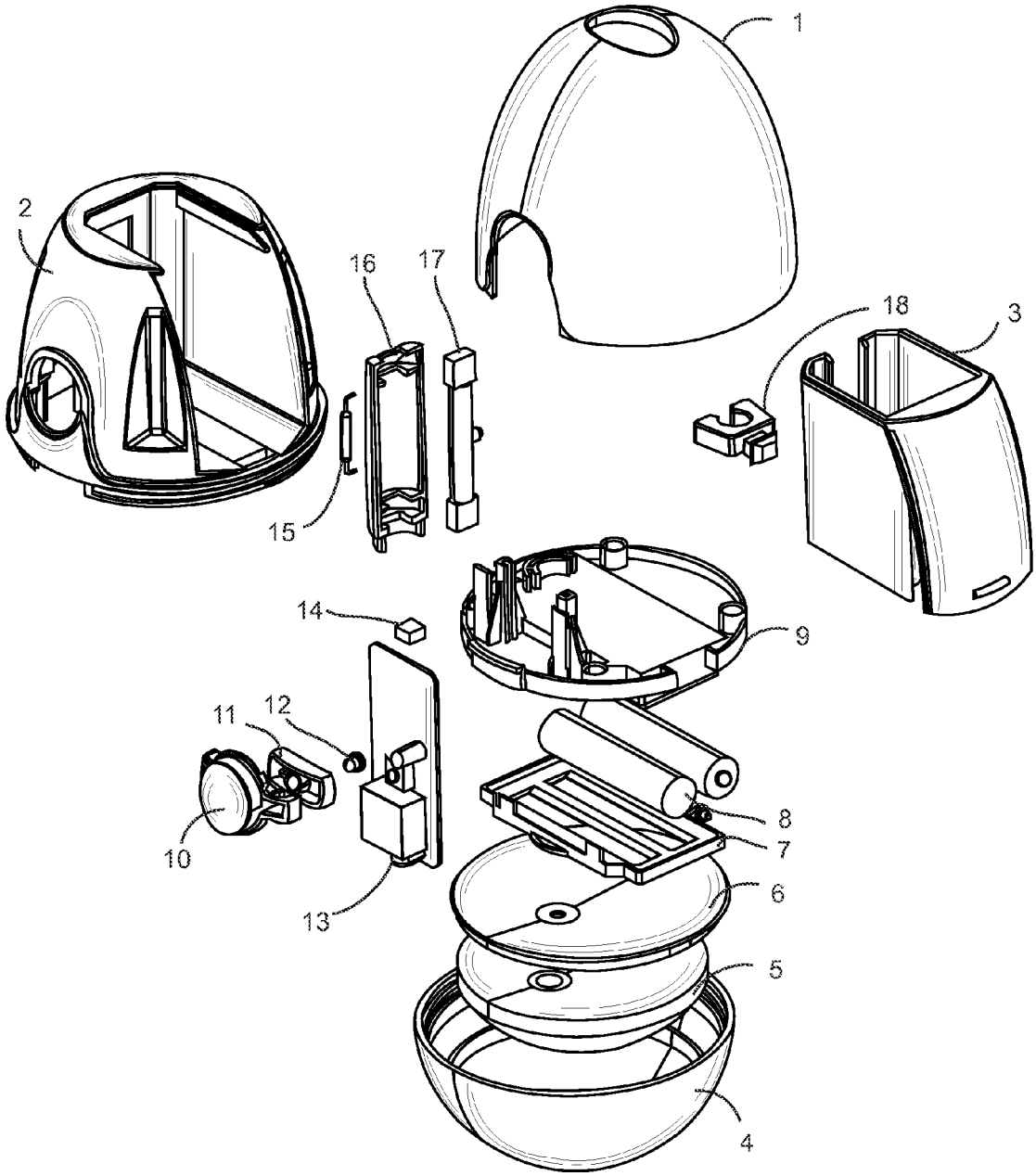
FIG. 11 is a detailed exploded view of the ROCKING TOOTHBRUSH SANITIZER of the present invention.

FIG. 1 is an exploded perspective view of the apparatus of the preferred embodiment of the present invention. FIG. 10 is a cross-sectional view of the ROCKING TOOTHBRUSH SANITIZER of the present invention. FIG. 11 is a detailed exploded view of the ROCKING TOOTHBRUSH SANITIZER of the present invention. Referring to FIGS. 1, 10, and 11, the apparatus of the present invention is provided with one or more apertures in top cover 1 for inserting a toothbrush as illustrated in FIG. 3. In the preferred embodiment, one aperture is used in cap 1, although other numbers of apertures may be used within the spirit or scope of the present invention.

Figure 2:
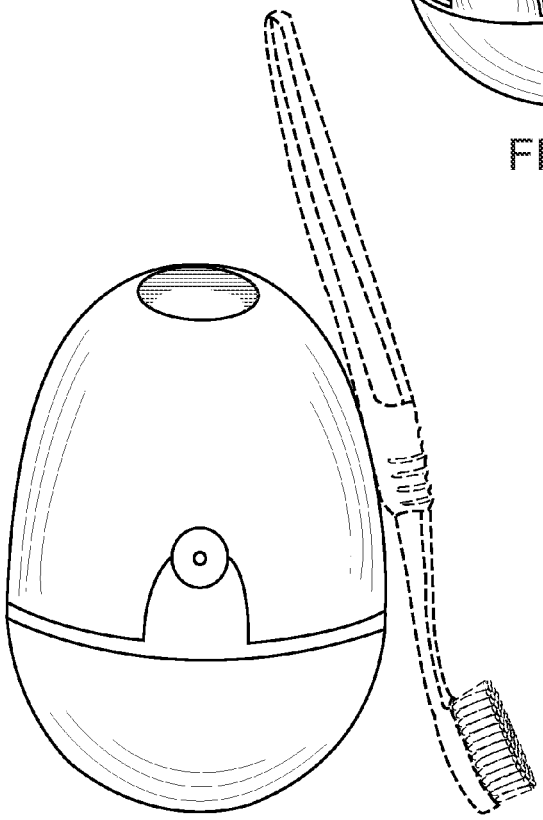
FIG. 2 is a front perspective view of the ROCKING TOOTHBRUSH SANITIZER of the present invention.

A toothbrush or the like may be inserted, bristles downward, into the apertures as illustrated in FIG. 3. In the example illustrated in FIG. 3, a toothbrush is illustrated inserted into the aperture. The toothbrush may comprise any of the type of traditional toothbrushes commercially sold. The apparatus of the present invention may be suitably modified to fit other types of toothbrushes such as those with bent necks and the like. FIG. 2 illustrates the relative size of the apparatus relative to a standard toothbrush.

In addition to toothbrushes, the apparatus of the present invention may also receive one or more electric toothbrush head(s) (or other apparatus to be sanitized). As will be discussed in more detail below, a removable peg may be inserted into the apertures in order to convert that aperture for use with an electric toothbrush head or other non-standard type of toothbrush or other apparatus (e.g., child's toothbrush).

Referring to FIGS. 1, 10, and 11, once a toothbrush or toothbrushes are inserted into the apparatus, a membrane or other type button switch 10 on the front of the device may be pressed to activate an internal ultraviolet (UV) bulb 17 placed in proximity to the toothbrushes as will be discussed below. The membrane button switch 10 may comprise a membrane covered microswitch, or other type of switch.

When the membrane button switch 10 is pressed, a timer/control circuit 13 may be activated. This timer/control circuit 13 may be implemented on an integrated circuit or with discrete components as is known in the art. The timer/control circuit may activate the UV bulb 17 for a first predetermined amount of time (e.g., 3 minutes) and then shut off. An LED light 12 may be illuminated while the device is operating, or to indicate a ready mode, or may indicate a variety of modes by flashing, blinking, or remaining steadily on or off. LED light cover 11 may channel light from LED light 12 through membrane button switch 10 to illuminate membrane button switch 10.

To prevent the recurrence of bacterial growth over time, the UV bulb may be automatically reactivated by the timer/control circuit 13 after a second predetermined amount of time (e.g., 6 hours) and activated for the first predetermined amount of time (e.g., 3 minutes) or another amount of time, as programmed. Thus, for example, every 6 hours, the UV bulb may be activated to restrain the growth of bacteria on the toothbrushes inserted in the apparatus.

Thus, a user may have confidence that the toothbrushes are at a constant state of cleanliness, no matter how long they have been left in the apparatus. Moreover, no intervention is required by the user to automatically reactivate the apparatus over time.

Referring back to FIG. 1, the apparatus comprises several main components as illustrated in FIG. 1, most of which may be fabricated from polycarbonate plastic or the like. Cap 1 contains the aperture as illustrated in FIG. 1. Body 4 forms the base of the unit and houses most of the components. Body 4 may be weighted with a weight 5 and/or batteries 8 or a combination of the two, as illustrated in FIGS. 10 and 11, to keep the center of gravity low and allow the device to stand upright on a flat surface. Cap 1 may be slidably fitted into body 4 such that the apparatus may be readily disassembled by the consumer.

Removable drip cup 3 may be formed of polycarbonate and treated with a reflective material (aluminized, Mylar treatments, or the like) to reflect UV rays around the toothbrushes. Removable drip cup 3 may be provided with one or more slots for accepting toothbrushes inserted into the apertures of cap 1. Removable drip cup 3 may be removed by the consumer by removing cap 1 and sliding out removable drip cup 3 from inner housing 2. Removable drip cup 3 may then be rinsed under a faucet and left to dry before reinserting into inner housing 2. In this manner, the apparatus may be readily disassembled and cleaned, unlike the prior art references discussed above.

Removable drip cup 3 may be provided with one or more toothbrush holders 18 which may be slidably mounted to drip cup 3 via a tab or the like. Toothbrush holder 18 may hold a toothbrush in proper orientation to UV lamp 17 and to prevent the toothbrush from rocking back and forth. Toothbrush holder 18 may be removable to allow for other types of toothbrushes or home dental appliances to be inserted (e.g., electric toothbrush heads). Toothbrush holder 18 may also be provided in different shapes to grip different brands and types of toothbrushes and other home dental appliances.

Removable height peg(s) may be provided to adjust the depth of one or more of the slots in removable drip cup 3 to modify the device for use with electric toothbrush heads or other devices. By inserting removable height peg(s) into one or more slots of removable drip cup 3, the depth of the slot in removable drip cup 3 is decreased, holding the bristles of an electric toothbrush head (e.g. Braun™ Oral B) for example, near the UV bulb 17. In this manner, the apparatus of the present invention may accept non-standard toothbrush heads, unlike the prior art references discussed above.

UV bulb 18 maybe provided with a reflector plate 16 to reflect light from the UV bulb 18 back toward a toothbrush head when in operation. To prevent inadvertent exposure to UV light, which may be harmful to the eyes, a reed or Hall-effect switch 15 may be used, in combination with magnet 14. Magnet 14 may be mounted to top cover 1 or drip cup 3 and reed or Hall effect switch 15 may be mounted to circuit board assembly 13 or other fixed portion of the apparatus such that when a user attempts to disassemble the unit, UV bulb 17 is extinguished, preventing potentially harmful UV rays from striking the eyes of the user.

UV/germicidal bulb 17 may comprise any one of a number of bulbs known on the market, such as those discussed above in connection with the Prior Art. In the preferred embodiment, a UV bulb emitting radiation at 253.7 nm wavelength is used. Such UV radiation provides a germicidal effect, killing most bacteria and germs. In addition, other types of germicidal bulbs may be used to disinfect items inserted into the apparatus of the present invention, including but not limited to heat bulbs or heat generators, or the like. A waterproofing ring (e.g., neoprene o-ring or the like) may be inserted onto the bulb where it screws into a socket in base 10 to prevent water from corroding or shorting out of the socket.

Note that in the preferred embodiment, cover 1 may be translucent so that the user can see the UV light action at work. Cover 1 may be made of a material (or suitably coated or the like) to filter out harmful UV rays. In the preferred embodiment, base 4 is made of an opaque material. Of course, both cover 1 and base 3 may be made of other types of materials without departing from the spirit and scope of the present invention.

Base 4 provides support for the apparatus, and also encloses the battery compartment and contains the counterweight 5. The battery compartment comprises battery box 9, batteries 8 (e.g., two "AA" or "AAA" batteries or the like), and battery door 7. Drip plate 6 may be provided to accumulate any dripping that is not caught by drip cup 3. Counterweight 5 may be made of lead or other suitably heavy material (steel, or the like) Counterweight 5 is sized, in combination with the weight of batteries 8, to prevent the apparatus from tipping over when a toothbrush is inserted. In use, the apparatus may rock or tip, but counterweight 5 returns the apparatus to an upright position, due to the curved nature of lower cover 4. Thus, the apparatus may be made compact in size, without worrying about the device tipping over on a vanity or countertop.

The circuit board may be a conventional type printed circuit board manufactured using techniques known in the art. The circuit board may be provided with power plug, which may accept input power from a wall-pack transformer or the like, typically in low voltage DC form. The Power plug may comprise a 2 mm PCB Power Connector, manufactured by CUI, INC, part number PJ-102A. In the preferred embodiment, however, a high power lithium batteries, or conventional alkaline batteries 8 ("AA" or "AAA") may be provided to power the circuit board and UV bulb. In this embodiment, the battery may be provided in the space occupied by circuit board and/or be provided mounted to the circuit board. The batteries may act as a ballast weight as well, providing the device with the rocking action. The activation button 10 may be provided with a lamp (e.g., LED 12) which may illuminate or flash when a low battery or battery change condition occurs.

Figure 4:
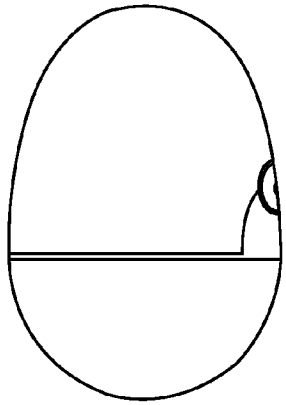
FIG. 4 is a front view of the ROCKING TOOTHBRUSH SANITIZER of the present invention.
Figure 5:
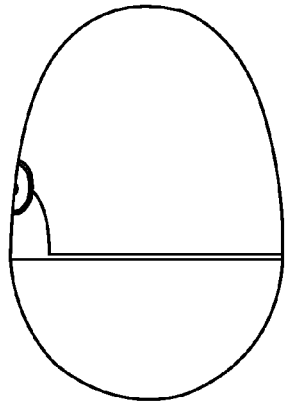
FIG. 5 is a rear view of the ROCKING TOOTHBRUSH SANITIZER of the present invention.
Figure 6:
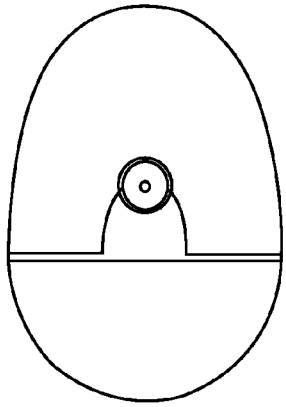
FIG. 6 is a left side elevational view of the ROCKING TOOTHBRUSH SANITIZER of the present invention.
Figure 7:
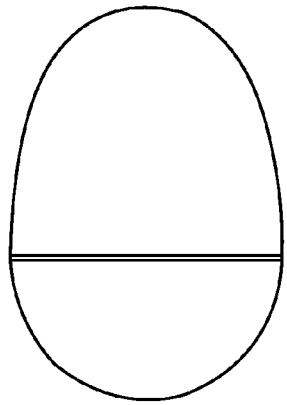
FIG. 7 is a right side elevational view of the ROCKING TOOTHBRUSH SANITIZER of the present invention.
Figure 8:
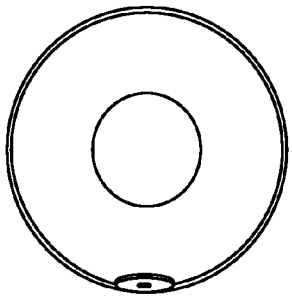
FIG. 8 is a top view of the ROCKING TOOTHBRUSH SANITIZER of the present invention.
Figure 9:
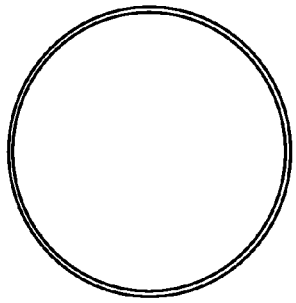
FIG. 9 is a bottom view of the ROCKING TOOTHBRUSH SANITIZER of the present invention.

FIGS. 2-10 illustrate the ornamental external appearance of the present invention as contemplated in the preferred embodiment. The ornamental external appearance of the present invention is claimed in a co-pending Design application incorporated by reference above. FIG. 2 is a front perspective view of the ROCKING TOOTHBRUSH SANITIZER of the present invention. FIG. 3 is a another front perspective view of the ROCKING TOOTHBRUSH SANITIZER of the present invention. FIG. 4 is a front view of the ROCKING TOOTHBRUSH SANITIZER of the present invention. FIG. 5 is a rear view of the ROCKING TOOTHBRUSH SANITIZER of the present invention. FIG. 6 is a left side elevational view of the ROCKING TOOTHBRUSH SANITIZER of the present invention. FIG. 7 is a right side elevational view of the ROCKING TOOTHBRUSH SANITIZER of the present invention. FIG. 8 is a top view of the ROCKING TOOTHBRUSH SANITIZER of the present invention. FIG. 9 is a bottom view of the ROCKING TOOTHBRUSH SANITIZER of the present invention.

As may be appreciated from the foregoing description, the present invention represents a significant improvement over may of the Prior Art devices. Many of the Prior Art devices cited above do not provide any safety features, or inadequate safety features, and as a result are not acceptable for consumer use. Devices such as the Andary device are too complex and difficult to clean, and also are unacceptable for consumer use. It is perhaps because of these concerns that an commercially successful UV toothbrush sanitizer has not emerged in the consumer market to date.

The present invention, in contrast, is simple and elegant in design, being made of only a few component parts. The safety system of the present apparatus allows the unit to be disassembled by the consumer for cleaning and the like, while maintaining UV safety. Moreover, the present invention can be adapted, via the adapter peg, to sanitize different types of items. In addition, the automatic operation of the present invention insures proper sanitation without user intervention.

In addition, the rocking feature of the present invention insures that the device, if tipped, will return to an upright position. This rocking feature allows the device to be made much smaller without fear that the small size will cause it to be knocked about on a bathroom countertop. The rocking feature of the present invention prevents the device from being tipped over and spilling its contents and/or being damaged. In addition, the rocking action provides a novelty feature that adults and children will find entertaining.

While the preferred embodiment and various alternative embodiments of the invention have been disclosed and described in detail herein, it may be apparent to those skilled in the art that various changes in form and detail may be made therein without departing from the spirit and scope thereof.

I claim:

1. A sanitizing apparatus, comprising:

a body for accepting at least one item to be sanitized, the body containing at least one germicidal lamp;

a removable cap, removably attached to the body, the removable cap provided with at least one orifice to accepting the item to be sanitized, the removable cap having at least one extended member for extending into the body of the sanitizing apparatus; and a cutoff switch in the body of the sanitizing apparatus, coupled to at least one of the at least one extended member of the removable cap, such that when the removable cap is removed, the at least one germicidal lamp is extinguished, wherein the body has a rounded bottom and is weighted such that the sanitizing apparatus sits upright on a flat surface and returns to an upright position if tipped.

2. The apparatus of claim 1, wherein the cutoff switch further comprises:

a magnet coupled to the removable cap, a magnetic switch, coupled to the body, such that when the removable cap is attached to the body, the magnet activates the magnetic switch and wherein when the removable cap is removed from the body, the magnetic switch is deactivated.

3. The apparatus of claim 1, further comprising:

a removable drip cup, removably mounted within the body of the apparatus beneath the cap, such that when the cap is removed from the body of the apparatus, the removable drip cup may be removed for cleaning.

4. The apparatus of claim 3, wherein the removable drip cup surrounds at least a portion of the item to be sanitized and reflects at least a portion of light emitted from the germicidal lamp onto the item to be sanitized.

5. The apparatus of claim 3, further comprising a removable toothbrush holder, slidably removable from the removable drip cup, the toothbrush holder holding the item to be sanitized inserted into the apparatus.

6. The apparatus of claim 1, further comprising a control circuit, coupled to the germicidal lamp, for controlling actuation of the germicidal lamp such that, once activated, the germicidal lamp is activated for a first predetermined time period, and then shut off for a second predetermined time period.

7. The apparatus of claim 6, wherein the control circuit further activates the germicidal lamp for the first predetermined time period after the second predetermined time period has lapsed.

8. A sanitizing apparatus, comprising:

a body for accepting at least one item to be sanitized, the body containing at least one germicidal lamp;

a removable cap, removably attached to the body, the removable cap provided with at least one orifice to accepting the item to be sanitized, the removable cap having at least one extended member for extending into the body of the sanitizing apparatus; and a control circuit, coupled to the germicidal lamp, for controlling actuation of the germicidal lamp such that, once activated, the germicidal lamp is activated for a first predetermined time period, and then shut off for a second predetermined time period, wherein the body has a rounded bottom and is weighted such that the sanitizing apparatus sits upright on a flat surface and returns to an upright position if tipped.

9. The apparatus of claim 8, wherein the control circuit further activates the germicidal lamp for the first predetermined time period after the second predetermined time period has lapsed.

10. The sanitizing apparatus of claim 8, further comprising a cutoff switch comprising:

a magnet coupled to the removable cap, a magnetic switch, coupled to the body, such that when the removable cap is attached to the body, the magnet activates the magnetic switch and wherein when the removable cap is removed from the body, the magnetic switch is deactivated.

11. The apparatus of claim 8, further comprising:

a removable drip cup, removably mounted within the body of the apparatus beneath the cap, such that when the cap is removed from the body of the apparatus, the removable drip cup may be removed for cleaning.

12. The apparatus of claim 11, wherein the removable drip cup surrounds at least a portion of the item to be sanitized and reflects at least a portion of light emitted from the germicidal lamp onto the item to be sanitized.

13. The apparatus of claim 11, further comprising a removable toothbrush holder, slidably removable from the removable drip cup, the toothbrush holder holding the item to be sanitized inserted into the apparatus.

14. A sanitizing apparatus, comprising:

a body for accepting at least one item to be sanitized, the body containing at least one germicidal lamp;

a removable cap, removably attached to the body, the removable cap provided with at least one orifice to accepting the item to be sanitized, the removable cap having at least one extended member for extending into the body of the sanitizing apparatus; and a removable drip cup, removably mounted within the body of the apparatus beneath the cap, such that when the cap is removed from the body of the apparatus, the removable drip cup may be removed for cleaning, wherein the body has a rounded bottom and is weighted such that the sanitizing apparatus sits upright on a flat surface and returns to an upright position if tipped.

15. The apparatus of claim 14, wherein the removable drip cup surrounds at least a portion of the item to be sanitized and reflects at least a portion of light emitted from the germicidal lamp onto the item to be sanitized.

16. The apparatus of claim 15, further comprising a removable toothbrush holder, slidably removable from the removable drip cup, the toothbrush holder holding the item to be sanitized inserted into the apparatus.

17. The apparatus of claim 15, further comprising:

a control circuit, coupled to the germicidal lamp, for controlling actuation of the germicidal lamp such that, once activated, the germicidal lamp is activated for a first predetermined time period, and then shut off for a second predetermined time period.

18. The apparatus of claim 17, wherein the control circuit further activates the germicidal lamp for the first predetermined time period after the second predetermined time period has lapsed.

19. The sanitizing apparatus of claim 14, further comprising:

a cutoff switch in the body of the sanitizing apparatus, coupled to the removable cap, such that when the removable cap is removed, the at least one germicidal lamp is extinguished.

20. The sanitizing apparatus of claim 19, wherein the cutoff switch further comprises:

a magnet coupled to the removable cap, a magnetic switch, coupled to the body, such that when the removable cap is attached to the body, the magnet activates the magnetic switch and wherein when the removable cap is removed from the body, the magnetic switch is deactivated, a safety mechanism, slidably mounted within the body of the apparatus, the safety mechanism coupling the cutoff switch with at least one of the at least one extended member of the removable cap.

* * * * *